United States Patent [19]

McEntire et al.

[11] 4,387,017

[45] Jun. 7, 1983

[54] DEMULSIFICATION OF BITUMEN EMULSIONS USING POLYMERS OF DIQUATERNARY AMMONIUM MONOMERS CONTAINING HYDROXYL GROUPS

[75] Inventors: Edward E. McEntire; David R. McCoy, both of Austin, Tex.

[73] Assignee: Texaco Inc., White Plains, N.Y.

[21] Appl. No.: 326,463

[22] Filed: Dec. 2, 1981

[51] Int. Cl.[3] ..... C10G 33/04

[52] U.S. Cl. ..... 208/188; 564/204; 252/358; 210/708; 210/732; 210/734; 210/737

[58] Field of Search ..... 208/188; 564/204; 252/358; 210/708, 732, 734, 737

[56] References Cited

U.S. PATENT DOCUMENTS

| | | | |
|---|---|---|---|
| 3,314,927 | 4/1967 | Kelley | 526/288 |
| 3,694,393 | 9/1972 | Lews et al. | 162/168.7 |
| 3,738,945 | 6/1973 | Panzer et al. | 210/736 |
| 3,766,156 | 10/1973 | Kine et al. | 525/163 |
| 3,962,332 | 6/1976 | Trapasso | 564/204 |

*Primary Examiner*—Delbert E. Gantz
*Assistant Examiner*—Helane E. Maull
*Attorney, Agent, or Firm*—Jack H. Park; Kenneth R. Priem; David L. Mossman

[57] ABSTRACT

A process for recovering bitumen from oil-in-water (O/W) emulsions is disclosed wherein water soluble demulsifiers are used. These demulsifiers are polymers of diquaternary ammonium monomers containing hydroxyl groups. To resolve the bituminous petroleum emulsions, the process is carried out between 25 and 160° C. wherein the demulsifier of the invention is contacted with the bituminous emulsion.

5 Claims, No Drawings

DEMULSIFICATION OF BITUMEN EMULSIONS USING POLYMERS OF DIQUATERNARY AMMONIUM MONOMERS CONTAINING HYDROXYL GROUPS

BACKGROUND OF THE INVENTION

1. Field of the Invention

This invention is concerned with the breaking or resolution of oil-in-water (O/W) bituminous emulsions by treatment with polymers of diquaternary ammonium monomers containing hydroxyl group.

2. Description of Related Art

A great volume of hydrocarbons exist in known deposits of tar sands. These deposits occur at various places, the Athabasca tar sands in Canada being an example. The petroleum in a tar sand deposit is an asphaltic bitumen of a highly viscous nature ranging from a liquid to a semi-solid. These bituminous hydrocarbons are usually characterized by being very viscous or even non-flowable under reservoir conditions by the application of driving fluid pressure.

Where surface mining is not feasible, the bitumen must be recovered by rendering the tar material mobile in-situ and producing it through a well penetrating the tar sand deposit. These in-situ methods of recovery include thermal, both steam and in-situ combustion and solvent techniques. Where steam or hot water methods are used, a problem results which aggravates the recovery of the bitumen. The difficulty encountered is emulsions produced by the in-situ operations. These emulsions are highly stable O/W emulsions which are made even more stable by the usual presence of clays. Most *liquid* petroleum emulsions are water-in-oil (W/O) types. These normal W/O emulsions are broken by methods known in the art. However, the bitumen emulsions which are O/W types present a much different problem, and the same demulsifiers used in W/O emulsion will not resolve the O/W bitumen emulsions.

C. W. W. Gewers, *J. Canad. Petrol. Tech.*, 7(2), 85–90 (1968)describes the uniqueness of emulsions encountered in the production of bitumen from tar sands.

U.S. Pat. No. 3,962,332 discloses diolefinically unsaturated compounds which contain two quaternary ammonium moities for use as flocculants and other uses.

SUMMARY OF THE INVENTION

The invention is a method for recovering petroleum from O/W bitumen emulsions by resolving or breaking these emulsions by contacting the emulsions at a temperature of from between about 25° and 160° C. with polymers prepared from the monomer having the following structure

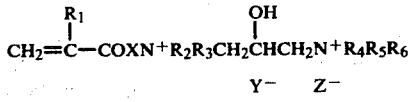

$R_1$=H or $CH_3$; $R_2$–$R_6$ are independently lower alkyl including branched alkyl, hydroxyethyl and hydroxypropyl; X=$NHR_7$ or $OR_7$ where $R_7$ is an alkylene or branched alkylene group having at least two (2) carbon atoms and Y and Z are independently halogen, carboxylate, or other anion from an acid of pKa <5. The above is also a new composition.

DESCRIPTION OF THE PREFERRED EMBODIMENTS

Useful in this invention is a method for recovering petroleum from O/W bitumen emulsions by resolving or breaking these emulsions by contacting the emulsions at a temperature of from between about 25° and 160° C. with polymers prepared from the monomer having the following structure

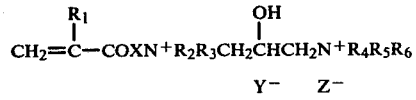

$R_1$=H or $CH_3$; $R_2$–$R_6$ are independently lower alkyl including branched alkyl, hydroxyethyl, hydroxypropyl; X=$NHR_7$ or $OR_7$ where $R_7$ is an alkylene or branched alkylene group having at least two (2) carbon atoms such as $CH_2CH_2$, $CH_2CH_2CH_2$ and $CH_2C(CH_3)_2CH_2$; and Y and Z are independently halogen or carboxylate such as acetate or other anion from an acid of pKa <5 such as methyl sulfonate.

Especially useful and preferred as demulsifiers of bitumen emulsions are polymers made from the above monomers wherein $R_1$=H or $CH_3$, X=$NHCH_2CH_2CH_2$ or $OCH_2CH_2$ and $R_2$–$R_6$=$CH_3$.

The polymers described are obtained by the reation of

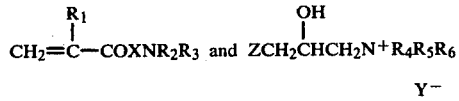

wherein the substituent groups are as defined above. However Z must be an easily displaced group such as chloride, or other anion from an acid with pKa <2. The preferred monomers thus made are:

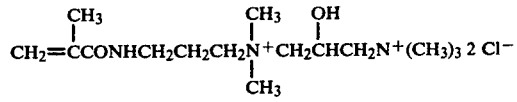

A.

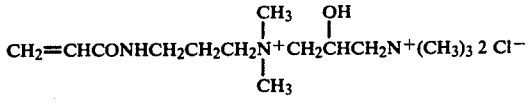

B.

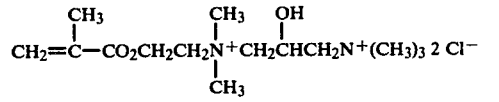

C.

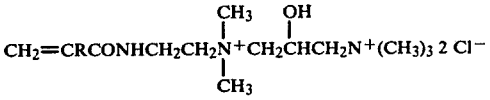

D.

where R is H or $Ch_3$

The produced bitumen emulsions may be treated by the process of our invention is a conventional manner, for example, in a conventional horizontal treater operated, for example, from about 25° to 160° C. and, preferably, from about 50°–150° C. at autogenous pressures. The concentration of the chemical demulsifier described above used in treating the bitumen in water emulsions may range from about 1 to 200 parts per million and, preferably, from about 10 to 150 parts per million with the optional addition of an organic diluent and/or inorganic salt as well as standard flocculants and mechanical or electrical means of demulsification. The following examples describe more fully the present process. However, these examples are given for illustration and are not intended to limit the invention.

Polymers for use as demulsifiers of bitumen emulsions are made by combining those monomers with a free radical initiator, preferably a free radical initiator using methods known to those skilled in the art. Polymers of greater than about 50,000 molecular weight are useful as demulsifiers of bitumen emulsions.

EXAMPLE I

To a glass reactor were added 17.1 g N-(3-dimethylaminopropyl)methacrylamide (DMAPMA); 37.8 g N-(3-chloro-2-hydroxypropyl)trimethylammonium chloride (50% aqueous; Dow's QUAT ® 188). A slight exotherm was observed on initial mixing. A sample was obtained. The reactor was heated to 70°–80° C. for five hours and sampled during and after heating. Analysis of the samples by nuclear magnetic resonance showed disappearance of DMAPMA and appearance of the product diquaternary ammonium compound. The reaction was complete in less than 5 hours at 70°–80° C. The pH of the solution was 5–6.

The structure of the product was shown by proton magnetic resonance as:

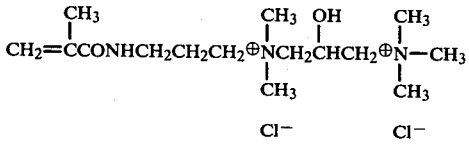

EXAMPLE II

An experiment similar to that of Example I was performed, but a large excess of the chloride was added, and the reaction temperature was 60° C. for four hours. The initial reaction mixture was 45 g DMAPMA and 200 g QUAT 188.

The diquaternary ammonium compound was polymerized as follows. To a polymerization kettle were charged 84.7 g of the above solution; 415.3 g deionized water; 0.5 g 2,2'-azo-bis(2-amidinopropane)hydrochloride initiator; 0.01 g ethylenediamine tetraacetic acid, disodium salt, dihydrate. After one hour of bubbling nitrogen through the solution to remove dissolved oxygen, the reactor was immersed in a water bath controlled at 50° C. This temperature was maintained for 5 hours and 40 minutes.

The pH of the solution was adjusted to 4.4 with 20% phosphoric acid and 1.0 g of the azo initiator was added. Nitrogen purging was repeated and the reactor was immersed in the 50° C. bath for 6 hours and 20 minutes.

Analysis of the product by liquid chromatography* showed that polymer comprised 59% of the organics, and that its molecular weight was ca. 0.5 million by comparison to polyacrylamide standards.

*High pressure liquid chromatography using 0.1N nitric acid as solvent and a functionalized silica support. The silica had pore sizes averaging 1,000 angstroms. The support was functionalized with amine groups.

EXAMPLE III

The method used for bottle testing candidate demulsifiers for bitumen-water systems is as follows:

(a) A 1 wt. % solution of each chemical was prepared in water.

(b) A 30 ml PYREX ® test tube equipped with screw top was charged with 23 ml emulsion of 11.5 wt. % bitumen content obtained by in-situ steam flooding in tar sand pattern located at Ft. McMurray, Alberta, Canada.

(c) 2 ml Wizard Lake crude oil was added as diluent and the contents of the test tube were mixed.

(d) The contents of the test tube were equilibrated in a 80° C. oven for 1–2 hours and mixed again.

(e) Chemical was added to the hot, dilute emulsion at the following concentrations: 30, 60, 120 ppm.

(f) Contents of the test tubes were mixed, re-equilibrated in an oven at 80° C. for 1 hour and mixed again.

(g) After 20 hours of standing at 80° C., measurements were made on the volume of top and middle layers, and the appearance of the aqueous phase was noted. Samples of some top layers were carefully removed by pipetting and subjected to Karl Fischer analysis for determination of the water content.

Results are shown on the following table. Included for comparison is a blank with no demulsifier present and examples using POLYOX ® (4,000,000 molecular weight polyethylene oxide), a known tar demulsifier described in U.S. Pat. No. 4,058,453.

TABLE I

DEMULSIFIER TESTING

| Example | Candidate Demulsifier | Concentration (ppm) | Oil Phase Volume in ml (% $H_2O$) | | Emulsion Phase Volume in ml (% $H_2O$) | Aqueous Phase Appearance |
|---|---|---|---|---|---|---|
| IIIa | None | — | 2.5 | | 2.5 | Muddy, dark |
| IIIb | POLYOX WSR-301 | 60 | 7 | (85.1) | 0.5 | Translucent, brown |
| IIIc | POLYOX WSR-301 | 120 | 7 | (95.4) | 1 | Translucent, brown |
| IIId | Product of Example II | 30 | 1 | | 6.5 | Muddy, dark |
| IIIe* | Product of Example II | 60 | 6 | (29.2) | 1.5 | Yellow, clear |
| IIIf* | Product of Example II | 120 | 10 | (4.29) | 0 | Colorless, clear |

*Emulsion broke immediately upon addition of demulsifier to give clear bottom layer

We claim:

1. A process for recovering petroleum from O/W bitumen emulsions by demulsifying said emulsions by adding thereto demulsifiers comprising polymers prepared from the monomer having the following structure

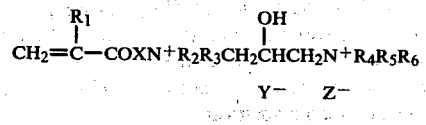

R=H, $CH_3$; $R_2$–$R_6$ are independently $CH_3$, $C_2H_5$, lower alkyl including branched alkyl, hydroxyethyl, hydroxypropyl; X=$NHR_7$ or $OR_7$, where $R_7$ is an alkylene or branched alkylene group such as $CH_2CH_2$, $CH_2CH_2CH_2$ having at least two carbon atoms and $CH_2C(CH_3)_2CH_2$; and Y and Z are independently halogen, carboxylate such as acetate or other anion from an acid of pKa <5.

2. A process as in claim 1 wherein the monomer has the structure:

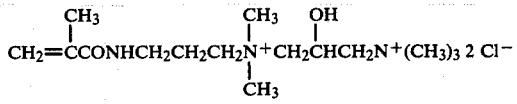

3. A process as in claim 1 wherein the monomer has the structure:

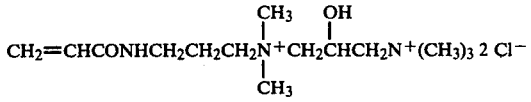

4. A process as in claim 1 wherein the monomer has the structure:

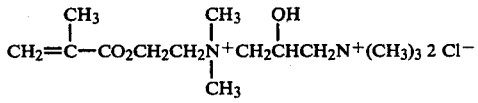

5. A process as in claim 1 wherein the monomer has the structure:

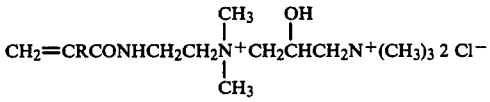

wherein R=H or $CH_3$.

* * * * *